United States Patent [19]

Arthur

[11] 4,052,579

[45] Oct. 4, 1977

[54] MOMENTARY CONTACT SWITCH HAVING PIVOTING ACTUATOR MOUNTED ON SWITCH BASE

[75] Inventor: Ronald H. Arthur, Fort Lauderdale, Fla.

[73] Assignee: AMF Incorporated, White Plains, N.J.

[21] Appl. No.: 667,244

[22] Filed: Mar. 15, 1976

[51] Int. Cl.[2] ..... H01H 3/12

[52] U.S. Cl. ..... 200/159 A; 200/283

[58] Field of Search ..... 200/159 A, 159 R, 275, 200/282, 283, 292, 238, 339, 340

[56] References Cited

U.S. PATENT DOCUMENTS

| | | | |
|---|---|---|---|
| 2,962,571 | 11/1960 | Zanichkowsky | 200/159 A |
| 3,749,872 | 7/1973 | Foster | 200/159 A |

*Primary Examiner*—Herman Hohauser

*Attorney, Agent, or Firm*—George W. Price; John H. Gallagher

[57] ABSTRACT

A momentary contact switch is comprised of an insulator base member having a plurality of aligned dome shaped contacts extending upwardly from the top face. First and second pairs of notches or voids extend through the base member beyond opposite ends of the aligned stationary contacts. An elongated plastic actuator is disposed above the stationary contacts and extends both transversely and longitudinally beyond the aligned contacts. The actuator has four yieldable legs at or adjacent its four corners which extend downwardly and each leg is inserted through a respective notch. One pair of legs is shorter than the other pair. Each leg has a barb or wedge shaped element at its bottom for releasably engaging the under side of the base member to maintain the actuator and base member in operative relationship. A movable spring contact member is disposed between the base member and actuator. The spring contact member is an elongated strip of thin, yieldable, conductive material that has a reverse bend intermediate its two ends to form long and short legs. The short leg has a seat or pocket formed therein which fits over and in contact with an end one of the stationary contacts. The reverse bend of the spring contact member is located closer to the pair of short legs of the actuator.

10 Claims, 4 Drawing Figures

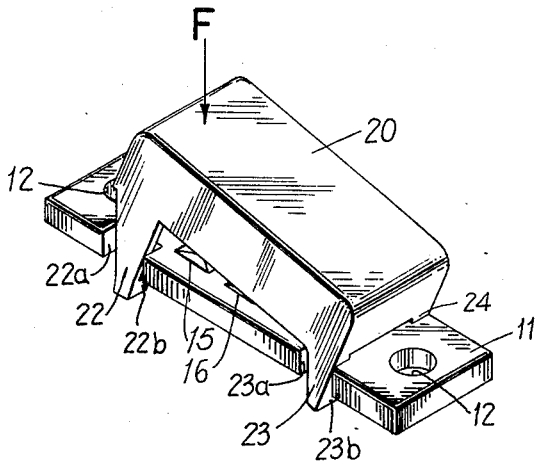
FIG. 1
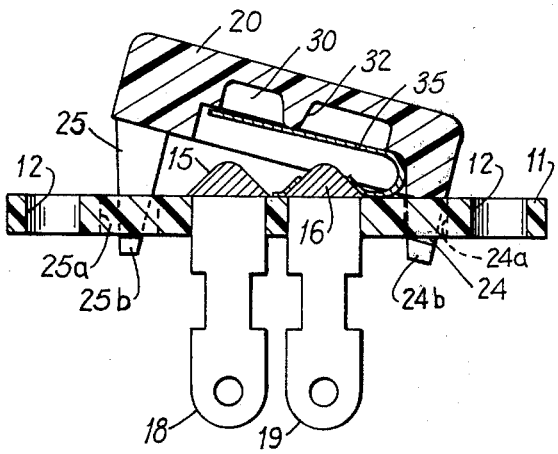
FIG. 2
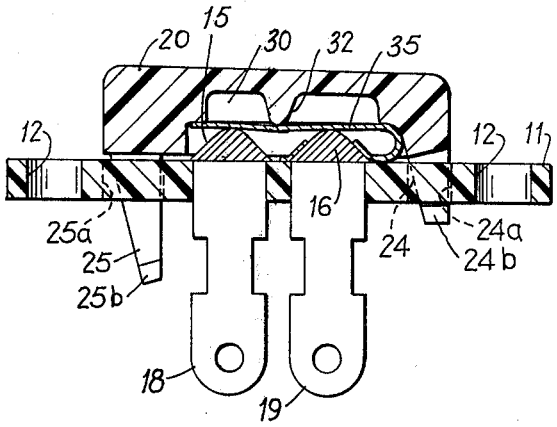
FIG. 3
FIG. 4
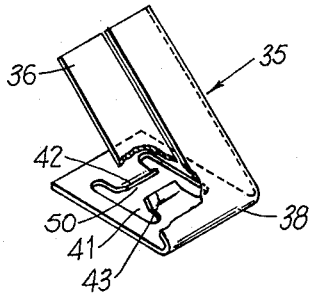

MOMENTARY CONTACT SWITCH HAVING PIVOTING ACTUATOR MOUNTED ON SWITCH BASE

This invention relates to a small momentary contact electrical switch which makes contact between stationary contacts only while an operator holds the switch actuator in a depressed position. The switch is small, reliable in operation, simple in construction, employs a minimum number of parts and is economical to manufacture and assemble.

The switch will be described by referring to the accompanying drawings wherein:

FIG. 1 is a perspective view of the momentary contact switch of this invention;

FIGS. 2 and 3 are longitudinal sectional views of the switch of FIG. 1 showing the switch, respectively, in a contacts open and contacts closed position; and FIG. 4 is an enlarged view of the movable spring contact employed in the switch.

Referring in detail to the drawings, the switch is comprised of a thin insulator base member 11 having mounting apertures 12 at each end. Base members 11 supports first and second dome shaped stationary contacts 15 and 16 which extend upwardly above the top surface of the base member. Respective connector terminals 18 and 19 extend downwardly through base member 11 to provide external connectors for stationary contacts 15 and 16.

The switch actuator 20 is an elongated generally rectangular shaped member molded from a plastic insulating material. Actuator 20 extends transversely across base member 11 and extends longitudinally beyond both end of the stationary contacts 15 and 16. Actuator 20 includes at or adjacent its four corners downwardly extending legs 22, 23, 24 and 25. Each of the legs 22–25 of actuator 20 is received within a respective notch or void *22a, 23a, 24a, 25a* on the two side edges of base member 11. Each leg includes at its lowermost portion a barb or wedge shaped element *22b, 23b, 24b* and *25b* which extends outwardly from the inner surface of its respective leg. Each barb has a horizontal top surface which is adapted to engage the bottom surface of insulator base member 11. As best seen in FIG. 1 the spacing between opposite pairs of legs 22, 25 and 23, 24 at the respective ends of the actuator 20 is such that the legs hold the actuator in pivotal engagement within the notches *22a–25a* in base member 11. The barbs *22b–25b* extend beyond the inner edges of the notches *22a–25a* and prevent the actuator from being withdrawn from the base member 11 once the actuator is assembled onto the base member. Legs 22–25 are sufficient resilient to allow their barbs *22b–25b* to be forced through the respective notches during assembly. For reasons which will become apparent from the description below, one pair of opposite legs 22 and 25 at one end of actuator 20 are longer than the pair of legs 23 and 24 at the opposite end of actuator 20.

The underside of actuator 20 has a recess 30 molded therein. A rib 32 extends transversely across recess 30.

A movable spring contact member 35 is received within the recess 30 in actuator 20. Spring contact member 35 is made of a thin, resilient, conductive material and is formed with a reverse bend so as to provide a long leg 36 and a short leg 37, see FIG. 4, which are disposed at an acute angle relative to the apex of the angle at the reverse bent portion 38. The short leg 37 has an I-shaped void 41 stamped therein, and the opposite edges 42 and 43 of the leg adjacent the stem of the I-shaped void are bent upwardly to form a seat or pocket 50 which is generally complementary in shape to a dome shaped contact. As seen in FIGS. 2 and 3, spring contact member 35 is positioned so that the pocket 50 on its short leg 37 receives the dome shaped stationary contact 16. The long leg 36 of spring contact member 35 is snugly received within the correspondingly shaped recess 30 in the underside of actuator 20. Therefore, movable spring contact member 35 is held in operable position by dome shaped contact 16 and actuator 20 and no additional fastening means, such as a rivet, is required.

As illustrated in FIG. 4, the long leg 36 of spring contact member 35 is split longitudinally along at least a portion of its length. This feature is not necessary but tends to add a redundancy feature to the contact established between stationary contacts 15 and 16.

FIG. 2 illustrates the switch in its normal, unactuated position. The spring force of spring contact member 35 causes the left end of actuator 20 to raise up until the barbs *22b* and *25b* at the bottom ends of legs 22 and 25 are in engagement with the bottom side of base member 11. The barbs prevent further upward movement of the left end of actuator 20. The legs 23 and 24 on the right end of actuator 20 are shorter than the legs 22 and 25 at the opposite end, and the barbs *23b* and *24b* are in engagement with the under surface of base member 11 when actuator 20 is in its unactuated position illustrated in FIG. 2.

To actuate the switch and thereby establish electrical contact between stationary contacts 15 and 16, a force is applied downwardly to the left end of actuator 20, see FIG. 1, to cause actuator 20 to pivot in a counterclockwise direction about the pivots established by the engagements of the barbs *23b* and *24b* with the underside of base member 11. The long leg 36 of spring contact member 35 yields to allow the actuator to be depressed until the long leg 36 of spring contact 35 is forced into engagement with both of the dome shaped stationary contacts 15 and 16. Upon removal of the depressing force F, the stored energy in spring contact member 35 causes the long arm 36 thereof to raise the left end of actuator 20 and electrical contact is broken between stationary contacts 15 and 16. Actuator 20 pivots in a clockwise direction until the barbs *22b* and *25b* on legs 22 and 25 engage the bottom surface of base member 11. The actuator then has returned to its normal, unactuated position illustrated in FIG. 2.

From the above description it is seen that the switch of this invention is quite simple, involves a minimum number of parts, and thus is economical to manufacture and assemble. No separate housing is required since actuator 20 serves, at least to an extent, as a switch housing. This feature not only eliminates the need for an extra part, but no operation such as staking or riveting is required to assemble the switch. With the present switch, spring contact member 35 is placed in position with pocket 50, FIG. 4, on stationary contact 16, actuator 20 is aligned over spring contact 35 and the yieldable legs 22–25 of actuator 20 are forced down over the notches *22a–25a* until the barbs *22b–25b* snap into position on the underside of base member 11.

Although the accompanying drawings and above description have disclosed a single pole embodiment of the invention, it is believed to be obvious that a switch of any desired number of poles may be constructed in accordance with the teachings of this invention. For example, one or more pairs of stationary contacts may be placed along side stationary contacts 15 and 16 on an insulating base member of appropriate width. A respective number of individual spring contact members identical to spring contact 35 would be included. Correspondingly, actuator 20 will be of the appropriate width to accommodate the required number of spring contacts so that in the depressed position illustrated in FIG. 3, each spring contact member identical to member 35 establishes connection between the stationary contacts of a respective pole. The pivoting action of actuator 20 and the reverse bent spring contact member 35 are ideally suited for multiple pole embodiments of this invention.

Additionally, the base member 11 need not be a rectangular strip with the notches or voids in its side edges. The principles of this invention are equally applicable to a large planar base member which has stationary contacts located in its interior region at considerable distances from the edges of the planar base member. In this instance, notches *22a–25a* would take the form of apertures or voids through the interior region of the base member. The apertures would have the same relative location to the stationary contacts as described above.

In its broader aspects, this invention is not limited to the specific embodiment illustrated and described. Various changes and modifications may be made without departing from the inventive principles herein disclosed.

What is claimed is:

1. A momentary contact switch for selectively establishing electrical connection between stationary contacts, said switch comprising a thin insulator base member having aligned on one face thereof a plurality of dome shaped stationary contacts which extend upwardly from said face, a first pair of notches or voids extending through said base member beyond one end of said aligned stationary contacts and a second pair of notches or voids extending through said base member beyond the other end of said aligned stationary contacts, the notches of each pair being on opposite sides of the aligned contacts, an elongated actuator of insulating material extending transversely across said stationary contacts and extending longitudinally beyond both ends of the aligned stationary contacts, said actuator including four downwardly extending yieldable legs each located to be inserted through a respective one of said notches or voids, a barb element on the bottom portion of each leg for engaging the underside of said base member and thereby releasably holding said legs within said notches or voids, a spring contact member formed of elongated, yieldable, conductive material and having a reverse bend intermediate its ends to form first and second legs, the first leg of the spring contact member having a pocket formed therein which is generally complementary in shape to a dome shaped contact for receiving therein an end one of the aligned stationary contacts, said actuator having a recess in its underside to receive and position the second leg of the spring contact member therein, the reverse bend of the spring contact member being located longitudinally beyond said end one of the aligned stationary contacts.

2. The combination claimed in claim 1 wherein said actuator is generally rectangular in shape and said four yieldable legs extend downwardly from respective locations at or adjacent the four corners of the actuator.

3. The combination claimed in claim 1 wherein the two yieldable legs on the actuator which are closest said one end of the stationary contacts are shorter in length than the other two actuator legs at the opposite end of the actuator.

4. The combination claimed in claim 2 wherein the barbs on said shorter actuator legs are in pivotal contact with the underside of the base member when a force is applied at said opposite end of the actuator to move said second arm of the spring contact into electrical connection with another one of said aligned stationary contacts.

5. A momentary contact switch for establishing electrical connection between stationary contacts only while the switch actuator is held in a depressed position, said switch comprising a thin insulator base member having at least two stationary contacts extending upwardly from one face of the base member, connector terminals extending from said stationary contacts on said base member, first and second pairs of notches extending through said base member, each pair of notches being longitudinally positioned on said base member beyond a respective stationary contact so that said stationary contacts are between said pairs of notches, an elongated, rectangular shaped actuator member of insulating material adapted to extend transversely across said stationary contacts and longitudinally over and beyond said stationary contacts, first and second pairs of yieldable legs extending downwardly from the actuator member, one pair of yieldable legs being located at or adjacent respective corners at one end of the actuator and the other pair of yieldable legs being located at or adjacent respective corners at the other end of the actuator, a barb or wedge shaped element located adjacent the bottom end of each of said legs, said notches being positioned and arranged on the base member to receive respective ones of said legs therein, the transverse spacing between each pair of legs being proportioned to cause said barbs or wedge shaped elements thereon to releasably engage the underside of said base member when the legs are inserted through said notches, said actuator having a recess in its underside adapted to receive a spring contact member, a spring contact member formed of elongated, yieldable, conductive material and having a reverse bend therein to form long and short legs disposed at an acute angle, said short leg having a pocket formed therein for receiving one of said stationary contacts to establish electrical connection therebetween and to physically position said spring contact on said base member and on said one stationary contact, said long leg being received in said recess in said actuator, one pair of yieldable legs at one end of the actuator being shorter than the other pair of legs at the other end of the actuator and having a length so that said actuator is pivotable about the barbs on the shorter pair of legs when those barbs are in engagement with the underside of the base member, the reverse bend in said spring contact member being located nearer the shorter pair of legs than the other pair of legs, the other pair of yieldable legs of the actuator having a length to permit said other end of the actuator to be pivoted upwardly away from the base member by the spring action of the long leg of the spring contact member, the barbs on said other pair of yieldable legs limiting the upward motion of the actuator to maintain the spring contact out of engagement with the other one of the stationary contacts, said long leg of the spring contact member establishing electrical connection between said two stationary contacts when a force is applied to said other end of the actuator to pivot it to an unactuated position adjacent said base member.

6. A momentary contact switch for establishing electrical connection between stationary contacts only while the actuator is held in a depressed position, said switch comprising a thin, generally rectangular shaped insulator base member having at least two dome shaped stationary contacts extending upwardly from one face of the base member, first and second pairs of notches or voids extending into the side edges of the base member, the first pair of notches being in opposite side edges at locations longitudinally beyond one end of said stationary contacts and the second pair of notches being in opposite side edges at locations longitudinally beyond the opposite end of said stationary contacts, an elongated, rectangular shaped actuator member of insulating material extending transversely across said base member and longitudinally over and beyond the stationary contacts, first and second pairs of yieldable legs each extending downwardly from the actuator at or adjacent a respective corner thereof, a barb or wedge shaped element located adjacent the bottom of each of said legs, said legs being positioned and arranged to be inserted through respective notches in the base member and said barbs or wedge shaped elements being positioned to releasably engaging the underside of the base member to prevent withdrawal of the legs from said notches, a spring contact member of elongated, yieldable conductive member and having a reverse bend therein to form long and short legs disposed at an acute angle, said short leg having a pocket formed therein which is complementary in shape to a dome shaped stationary contact for receiving one of the dome shaped stationary contacts to establish electrical connection therebetween and to position said spring contact on said base member and said one stationary contact, a recess in the underside of said actuator for receiving and positioning the long arm of the spring contact member within the actuator, the pair of legs of the actuator closest said one stationary contact being shorter than the other pair of legs and the barbs of the shorter legs being in pivotable engagement with the underside of the base member, the reverse bend in the spring contact member being positioned closer the shorter legs of the actuator than the other legs and the legs of the spring contact member extending toward the other pair of legs of the actuator, said other pair of legs having a length to permit their respective end of the actuator to be pivoted upwardly away from the base member by said long leg of the spring contact member, the barbs on said other pair of legs limiting the upper motion of the actuator to maintain said long arm of the spring contact out of contact with the other one of the stationary contacts, said long leg of the spring contact member establishing electrical connection between the stationary contacts when a force is applied to pivot the actuator to an actuated position closely adjacent the base member.

7. A momentary contact switch for selectively establishing electrical connection between stationary contacts, said switch comprising a thin insulator base member having aligned on one face thereof a plurality of stationary contacts that extend upwardly from said face, an elongated actuator of insulating material extending transversely across said stationary contacts and extending longitudinally beyond both ends of the aligned stationary contacts, said actuator including on both sides thereof a plurality of yieldable legs extending downwardly below the bottom edge of said base member, a barb element on the bottom portion of each leg for engaging the underside of said base member and thereby normally preventing withdrawal of the actuator from the base member, spring contact means engaging said actuator and, upon actuation of the switch, engagable with given stationary contacts, said spring contact means operating to normally keep the actuator spaced from the stationary contacts a predetermined distance and to maintain all of said barbs in contact with the underside of the base member, said spring contact means making electrical connection between stationary contacts on the base member only when the actuator is moved toward the base member a given distance, the movement of the actuator toward the base member causing at least some of the barbs to disengage from the underside of the base member.

8. The combination claimed in claim 7 wherein said actuator is generally rectangular in shape of said yieldable legs extend downwardly from respective locations at or adjacent the corners of the actuator.

9. The combination claimed in claim 8 wherein a pair of said legs at one end of the actuator are shorter than other ones of said legs, the lengths of said shorter legs being selected so that the barbs on the shorter legs remain in substantial engagement with the underside of the base member when the actuator moves toward the base member, whereby the actuator moves with a pivoting motion toward the base member.

10. The combination claimed in claim 9 wherein said stationary contacts are dome shaped, and said spring contact means is formed of elongated, conductive material having a reverse bend intermediate its ends to form first and second legs, the first leg of the spring contact means having a pocket formed therein which is generally complementary in shape to a dome shaped contact, said pocket of the first arm being seated on a dome shaped stationary contact, means in the underside of the actuator for receiving the second leg of the spring contact means for yieldingly holding one end of the actuator away from the base member.

* * * * *